US005227759A

United States Patent [19]

Hatagishi

[11] Patent Number: 5,227,759

[45] Date of Patent: Jul. 13, 1993

[54] PLUG-IN FUSE

[75] Inventor: Yuji Hatagishi, Shizuoka, Japan

[73] Assignee: Yazaki Corporation, Japan

[21] Appl. No.: 903,352

[22] Filed: Jun. 24, 1992

[30] Foreign Application Priority Data

Jun. 25, 1991 [JP] Japan ..... 3-048190[U]

[51] Int. Cl.[5] ..... H01H 85/143

[52] U.S. Cl. ..... 337/260; 337/251; 337/297; 439/621

[58] Field of Search ..... 337/260, 261, 268, 269, 337/251, 254, 297; 439/86, 621

[56] References Cited

U.S. PATENT DOCUMENTS 3,909,767 9/1975 Williamson et al. ..... 337/264

4,394,639 7/1983 McGalliard ..... 337/297

FOREIGN PATENT DOCUMENTS 53-109156 9/1978 Japan .

*Primary Examiner*—Harold Broome

*Attorney, Agent, or Firm*—Wigman & Cohen

[57] ABSTRACT

A substrate-type plug-in fuse to be directly inserted into slots of a pair of pressure terminals, including a substrate on a surface of which a fuse-forming pattern and terminal-forming patterns are provided, wherein the substrate is made of elastic material so that the terminal portions of the substrate can shrink and press against walls of the slots when inserted in the slots, thereby maintaining good conductivity between the fuse and the pressure terminals.

7 Claims, 2 Drawing Sheets

PLUG-IN FUSE

BACKGROUND OF THE INVENTION

This invention relates to a current overload fuse, and in particular to a plug-in fuse formed on a substrate.

A conventional plug-in fuse is disclosed in U.S. Pat. No. 3,909,767. The plug-in fuse is preferably disposed in a housing. Also, a substrate-type plug-in fuse is disclosed in Japanese Patent (A) 53-109,156. In the Japanese patent application, a plurality of circuits as fuses are printed on front and rear surfaces of a substrate made of thermosetting property resin such as phenol resin. The circuits are plated with tin of a predetermined thickness in order to enhance the conductivity. The circuits are to be inserted in socket openings and received by pressure spring clips in the openings. When the substrate is inserted in the socket openings, the circuits are scratched by the pressure spring clips, and the plating may be peeled from the substrate. As a result, failure in the conductivity occurs.

In the market there is a need of plug-in fuses which can be directly inserted in pressure terminals.

The object of the present invention is therefore to provide a substrate-type plug-in fuse which can be directly plugged in slots of the pressure terminals and absorb force caused on the terminals of the fuse by the pressure terminals in order to maintain good conductivity.

SUMMARY OF THE INVENTION

In one embodiment of the invention, a substrate-type plug-in fuse inserted in slots of a pair of pressure terminals includes a substrate on a surface of which a fuse-forming pattern and terminal-forming patterns are provided, wherein the substrate is made of elastic material so that the terminal portions of the substrate are compressed between the walls of the slots when inserted therein. The elastic material is preferably liquid crystal polymer.

In another embodiment of the invention, a substrate-type plug-in fuse of this invention to be inserted in slots of a pair of pressure terminals includes a substrate on surfaces of which a fuse-forming pattern and terminal-forming patterns are provided, wherein the terminal portions of the substrate are plated with relatively thick conductive material, the thickness of the substrate at the terminal portions being slightly less than width of each slot of the clip terminals, and the thickness of each plated terminal portion being slightly larger than the width of the slot.

Anyone of the plug-in fuses of the above is preferably provided at its central part with a transparent insulating holder.

According to the first embodiment of the invention wherein the configuration of the substrate-type plug-in fuse of which substrate is made of elastic material, when the terminal portions of the fuse are inserted in the slots of the pressure terminals, the compressive force applied by the pressure terminals against the substrate causes it to be compressed between the walls of the slots of the pressure terminals. Hence, the terminal portions of the fuse are not damaged by the pressure terminals and are securely contacted with the pressure terminals, and as a result good conductivity is achieved between the fuse and the pressure terminals.

According to the second embodiment of the invention wherein the configuration of the substrate-type plug-in fuse of which terminal portions are plated with relatively thick conductive materials, when the terminal portions of the fuse are inserted in the slots of the pressure terminals, a portion of the plating of the terminal portions is scratched off by the walls of the pressure terminals when the substrate is inserted into the slots, and the walls become imbedded in the terminal portions. Hence, the terminal portions of the fuse effectively contact pressure terminals, and as a result good conductivity is achieved similarly.

Anyone of the above fuses can be directly connected to the pressure terminals by inserting the terminal portions in the slots of the pressure terminals. The fuse may be handled by the transparent insulating holder mounted on the fuse body.

DESCRIPTION OF THE PREFERRED EMBODIMENTS

Figure 1:
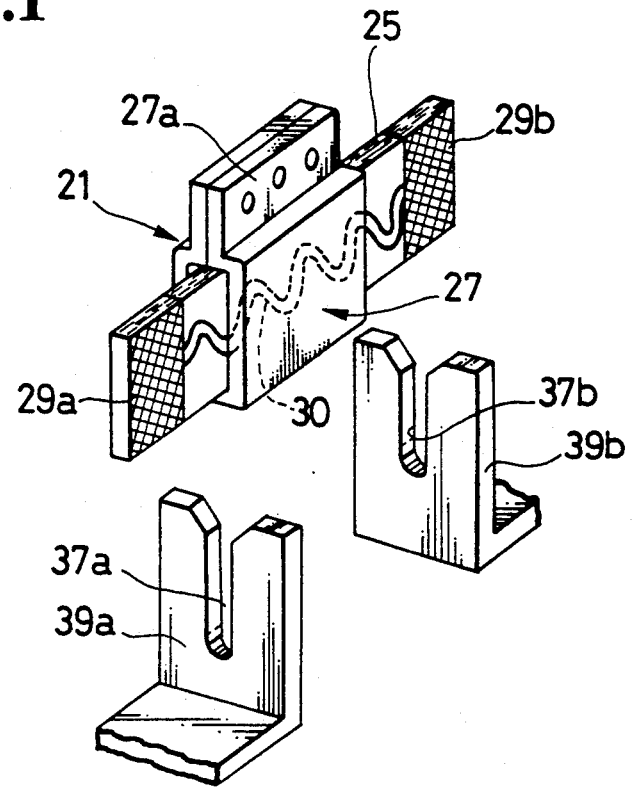
FIG. 1 is a perspective view showing a first embodiment of a substrate-type plug-in fuse of the present invention and a pair of pressure terminals which receive the fuse.

FIG. 1 shows a first embodiment of a substrate-type plug-in fuse 21 comprised of a substrate 25 and a transparent insulating holder 27 which encloses a central portion of the substrate 25. The substrate 25 is in the shape of a plate and is made of elastic material such as liquid crystal polymer. The liquid crystal polymer is polymer made of rigid linear macromolecule. The linear molecular chains of the polymer are oriented in a direction as shown in FIG. 1.

A fuse-forming pattern 30 and terminal-forming patterns are respectively printed on a central part and end parts of a surface of the substrate 25 by photoetching or the like. The printed terminal-forming patterns are plated with tin in order to constitute terminals **29*a* and 29*b*** of good conductivity.

Figure 2:
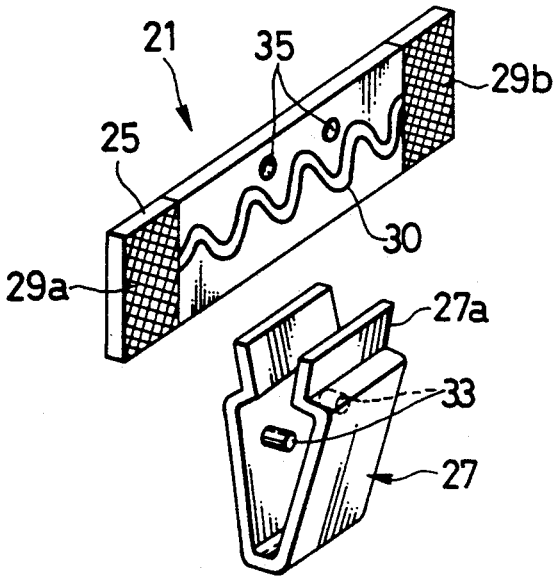
FIG. 2 is an exploded view of the plug-in fuse of FIG. 1.

FIG. 2 shows a state where the substrate 25 and the fuse holder 27 are separated from each other to make it easy to understand how the substrate 25 is attached to the insulating holder 27. The fuse holder 27 has a plurality of, for example two as shown in the drawing, projections 33, 33 while the substrate 25 has corresponding small holes 35, 35 which receive the projections 33, 33 of the fuse holder 27. The fuse holder 27 is attached to the substrate 25 to cover the central portion of the substrate by inserting the projections 33, 33 in the holes 35, 35 of the substrate. Top portions **27*a*, 27*a* of the fuse holder 27 are then sealed. The fuse pattern 30 can be seen by the transparent fuse holder 27. The substrate-type fuse 21 can be handled through the fuse holder 27** and directly inserted in pressure terminals.

Figure 3:
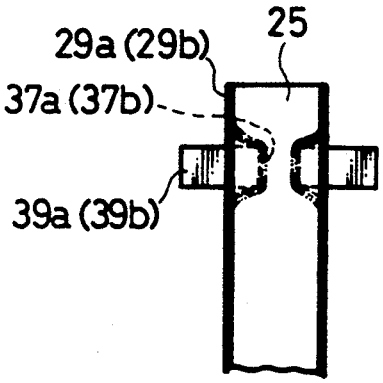
FIG. 3 is a plan view of the fuse and the pressure terminal of FIG. 1, showing the fuse received by the terminal.

As shown in FIGS. 1 and 3, the terminal portions 29*a*, 29*b* of the plug-in fuse 21 are to be inserted in slots 37*a*, 37*b* of a pair of pressure terminals 39*a*, 39*b*. The width of each slots 39*a*, or 39*b* is slightly less than thickness of the terminal portion 29*a*, 29*b*. Hence, the terminal portions 29*a*, 29*b* are pressed against walls of the slots 37*a*, 37*b* of the pressure terminals 39*a*, 39*b* when inserted in the slot. The plating of the terminal portions is, however, not rubbed so hard by the pressure terminals 39*a*, 39*b* since the terminal portions 29*a*, 29*b* shrink as shown in FIG. 3, and therefore the plating is not damaged. Hence, good conductivity is maintained between the fuse 21 and the pressure terminals 39*a*, 39*b*.

Figure 4:
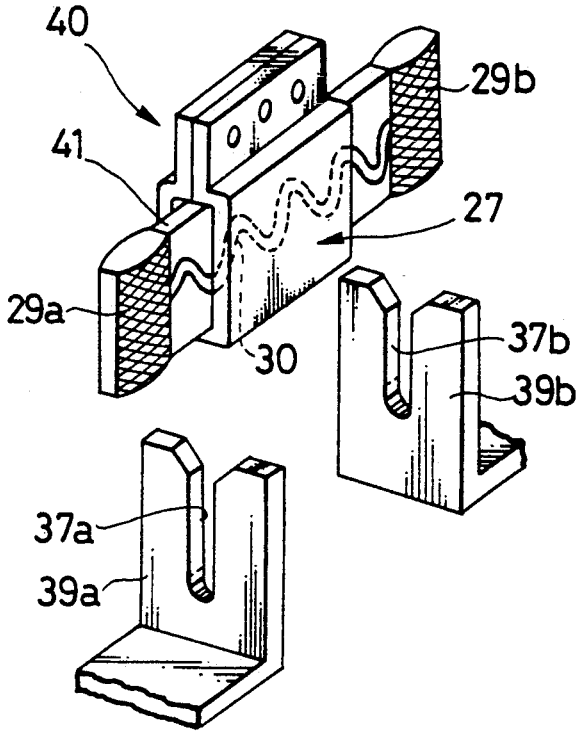
FIG. 4 is a perspective view showing a second embodiment of the substrate-type plug-in fuse of the present invention, and a pair of pressure terminals which receive the fuse.
Figure 5:
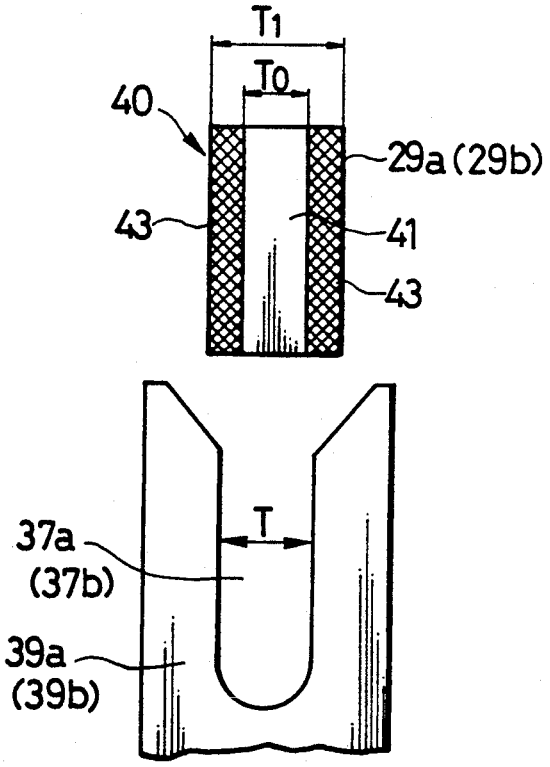
FIG. 5 is a side view of the plug-in fuse and the pressure terminal of FIG. 4, showing the relation of thickness of the fuse and width of the pressure terminal.
Figure 6:
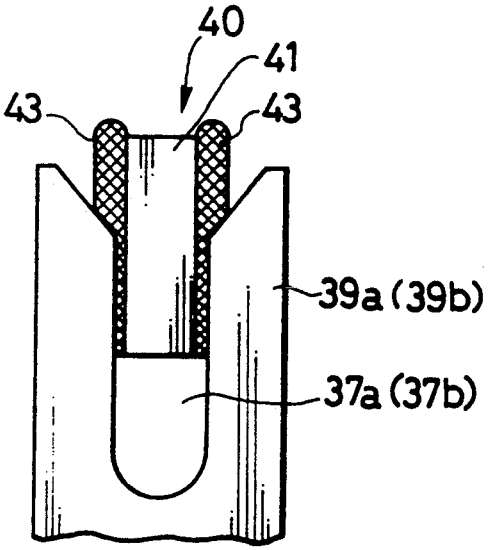
FIG. 6 is a side view showing a terminal portion of the plug-in fuse of FIG. 4 received by the pressure terminal.

With reference to FIGS. 4 to 6, a second embodiment of the substrate-type plug-in fuse of the present invention is explained. In the second embodiment, the same reference numerals are used for elements the same as that of the first embodiment, and a further description for the elements is omitted.

In this embodiment, the substrate-type plug-in fuse 40 has a substrate 41 which is in the shape of a plate and is made of thermosetting property resin of which thickness is $T_0$. A fuse-forming pattern 30 and terminal-forming patterns are printed on both front and rear surfaces of the substrate 40 in this embodiment. The surfaces of terminal portions 29*a*, 29*b* of the substrate 41 are plated with relatively thick tin ($S_n$) 43, 43. The thickness of the tin plating 43 is more than 5 $\mu$m and is exaggeratedly shown in FIGS. 4 to 6. Total thickness of each of the terminal portions 29*a*, 29*b* is $T_1$. The terminal portions 29*a*, 29*b* are to be inserted in slots 37*a*, 37*b* of a pair of pressure terminals 39*a*, 39*b*. The width of each slot 37*a*, 37*b* is T which is greater than the thickness $T_0$ of the substrate 41 and is less than the thickness $T_1$ of the terminal 29*a*, 29*b* ($T_0<T<T_1$).

When the terminals 29*a*, 29*b* of the fuse 40 are plugged in the slots 37*a*, 37*b* of the pressure terminals 39*a*, 39*b* as shown in FIG. 6, the tin plating 43, 43 absorbs the force of the pressure terminals 39*a*, 39*b*, while being planed by the pressure terminals 39*a*, 39*b* to some extent. However, the plating of thickness of $(T-T_0)/2$ remains, and therefore good conductivity between the fuse 41 and the pressure terminals 39*a*, 39*b* is maintained through the remaining plating.

We claim:

1. A substrate-type plug-in fuse, comprising:

a substrate on a surface of which a fuse-forming pattern interconnected with terminal-forming patterns are provided, said terminal-forming patterns being formed at terminal portions of the substrate; and a pair of pressure terminals each having a pair of walls defining a slot having a predetermined width;

wherein said terminal portions have a thickness greater than the width of said slot whereby said walls will deform said terminal portions when said terminal portions are inserted into said slots to form a positive electrical interconnection therebetween.

2. The substrate-type plug-in fuse of claim 1, wherein said substrate is made of elastic material so that the terminal portions are compressed by the walls of said pressure terminals when said substrate is inserted into said slots.

3. The plug-in fuse of claim 2, wherein the elastic material is formed from liquid crystal polymer.

4. The substrate-type plug-in fuse of claim 2, wherein the fuse is substantially plate-shaped, and wherein the fuse-forming pattern is provided on a central part of the substrate, the central part being covered with a transparent insulating holder.

5. The substrate-type plug-in fuse of claim 1, said terminal portions being plated with a conductive material, and wherein a portion of said conductive material is scratched off by the walls of said pressure terminals when said substrate is inserted into said slots, whereby said walls become imbedded in said terminal portions.

6. The substrate-type plug-in fuse of claim 5, wherein the fuse is substantially plate-shaped, and wherein the fuse-forming pattern is provided on a central part of the substrate, the central part being covered with a transparent insulating holder.

7. The substrate-type plug-in fuse of claim 5, wherein the thickness of said substrate at each of said terminal portions is less than said slot width, and the thickness of each of said plated terminal portions is greater than said slot width.

* * * * *